US010787807B1

(12) United States Patent
Robinson

(10) Patent No.: US 10,787,807 B1
(45) Date of Patent: Sep. 29, 2020

(54) JOINT SEAL WITH MULTIPLE COVER PLATE SEGMENTS

(71) Applicant: Schul International Co., LLC, Pelham, NH (US)

(72) Inventor: Steven R. Robinson, Windham, NH (US)

(73) Assignee: Schul International Co., LLC, Pelham, NH (US)

( * ) Notice: Subject to any disclaimer, the term of this patent is extended or adjusted under 35 U.S.C. 154(b) by 0 days.

(21) Appl. No.: 16/420,313

(22) Filed: May 23, 2019

(51) Int. Cl.
*E04B 1/68* (2006.01)

(52) U.S. Cl.
CPC ..... *E04B 1/6812* (2013.01); *E04B 1/68* (2013.01); *E04B 1/6803* (2013.01); *E04B 1/6815* (2013.01)

(58) Field of Classification Search
CPC ..... E04B 1/68; E04B 1/6801; E04B 1/6803; E04B 1/6813; E04B 1/6815; E04B 1/6812
See application file for complete search history.

(56) References Cited

U.S. PATENT DOCUMENTS 4,784,516 A * 11/1988 Cox ..... E01C 11/10 14/73.1
4,815,247 A * 3/1989 Nicholas ..... E04B 1/6803 404/47
6,219,982 B1 * 4/2001 Eyring ..... E04B 1/6803 52/393
6,532,708 B1 * 3/2003 Baerveldt ..... E01D 19/06 404/47
8,317,444 B1 11/2012 Hensley
8,341,908 B1 1/2013 Hensley et al.
8,365,495 B1 2/2013 Witherspoon
8,739,495 B1 6/2014 Witherspoon
8,813,449 B1 8/2014 Hensley et al.
8,813,450 B1 8/2014 Hensley et al.
8,870,506 B2 10/2014 Hensley et al.
9,068,297 B2 6/2015 Hensley et al.
9,200,437 B1 12/2015 Hensley et al.
9,206,596 B1 12/2015 Robinson
9,322,163 B1 4/2016 Hensley
9,404,581 B1 8/2016 Robinson
9,528,262 B2 12/2016 Witherspoon
9,631,362 B2 4/2017 Hensley et al.
9,637,915 B1 5/2017 Hensley et al.
9,644,368 B1 5/2017 Witherspoon
9,670,666 B1 6/2017 Witherspoon et al.
9,689,157 B1 6/2017 Hensley et al.
9,689,158 B1 6/2017 Hensley et al.
9,739,049 B1 8/2017 Robinson
9,739,050 B1 8/2017 Hensley et al.
9,745,738 B2 8/2017 Robinson
9,765,486 B1 9/2017 Robinson
9,803,357 B1 10/2017 Robinson
9,840,814 B2 12/2017 Robinson
9,850,662 B2 * 12/2017 Hensley ..... E04B 1/6813
(Continued)

*Primary Examiner* — Andrew J Triggs
(74) *Attorney, Agent, or Firm* — Crain, Caton & James, P.C.; James E. Hudson, III

(57) ABSTRACT

A system creates a durable water-resistant seal in the joint between adjacent panels. The durable expansion seal system includes an elastically-compressive body, a first cover plate segment, a second cover segment, and one or more ribs which provide a seal against water when inserted between substrates and permitted to expand to fit the gap between them.

9 Claims, 3 Drawing Sheets

(56) References Cited

U.S. PATENT DOCUMENTS 9,856,641 B2 1/2018 Robinson
9,951,515 B2 4/2018 Robinson
9,963,872 B2 5/2018 Hensley et al.
9,982,428 B2 5/2018 Robinson
9,982,429 B2 5/2018 Robinson
9,995,036 B1 6/2018 Robinson
10,000,921 B1 6/2018 Robinson
10,060,122 B2 8/2018 Robinson
10,066,386 B2 9/2018 Robinson
10,066,387 B2 9/2018 Hensley et al.
10,081,939 B1 9/2018 Robinson
10,087,619 B1 10/2018 Robinson
10,087,620 B1 10/2018 Robinson
10,087,621 B1 10/2018 Robinson
10,072,413 B2 11/2018 Hensley et al.
10,125,490 B2 11/2018 Robinson
10,179,993 B2 1/2019 Hensley et al.
10,184,243 B2 1/2019 Hamilton et al.
10,203,035 B1 2/2019 Robinson
10,213,962 B2 2/2019 Robinson
10,227,734 B1 3/2019 Robinson
10,233,633 B2 3/2019 Robinson
10,240,302 B2 3/2019 Robinson
10,280,610 B1 5/2019 Robinson
10,280,611 B1 5/2019 Robinson
10,316,661 B2 6/2019 Hensley et al.
10,323,360 B2 6/2019 Robinson
10,323,407 B1 6/2019 Robinson
10,323,408 B1 6/2019 Robinson
10,323,409 B1 6/2019 Robinson
10,352,003 B2 7/2019 Robinson
10,352,039 B2 7/2019 Robinson
10,358,777 B2 7/2019 Robinson
10,358,813 B2 7/2019 Robinson
10,385,518 B2 8/2019 Robinson
10,385,565 B2 8/2019 Robinson
10,407,901 B2 9/2019 Robinson
10,422,127 B2 9/2019 Hensley et al.
10,480,136 B2 11/2019 Robinson
10,480,654 B2 11/2019 Robinson
10,519,651 B2 12/2019 Hensley et al.
10,533,315 B2 1/2020 Robinson
10,533,316 B1 1/2020 Robinson
2005/0066600 A1* 3/2005 Moulton ..... E01D 19/06 52/393
2011/0135387 A1* 6/2011 Derrigan ..... E01D 19/06 404/69
2014/0219719 A1 8/2014 Hensley et al.
2014/0360118 A1 12/2014 Hensley et al.
2015/0068139 A1 3/2015 Witherspoon
2017/0130450 A1 5/2017 Witherspoon
2017/0159817 A1 6/2017 Robinson
2017/0191256 A1 7/2017 Robinson
2017/0226733 A1 8/2017 Hensley et al.
2017/0241132 A1 8/2017 Witherspoon
2017/0254027 A1 9/2017 Robinson
2017/0268222 A1 9/2017 Witherspoon et al.
2017/0292262 A1 10/2017 Hensley et al.
2017/0298618 A1 10/2017 Hensley et al.
2017/0314213 A1 11/2017 Robinson
2017/0314258 A1 11/2017 Robinson
2017/0342665 A1 11/2017 Robinson
2017/0342708 A1 11/2017 Hensley et al.
2017/0370094 A1 12/2017 Robinson
2018/0002868 A1 1/2018 Robinson
2018/0016784 A1* 1/2018 Hensley ..... E04C 2/20
2018/0038095 A1 2/2018 Robinson
2018/0106001 A1 4/2018 Robinison
2018/0106032 A1 4/2018 Robinison
2018/0119366 A1 5/2018 Robinison
2018/0142465 A1 5/2018 Robinison
2018/0148922 A1 5/2018 Robinison
2018/0163394 A1 6/2018 Robinison
2018/0171564 A1 6/2018 Robinison
2018/0171625 A1 6/2018 Robinison
2018/0202148 A1 7/2018 Hensley et al.
2018/0238048 A1 8/2018 Robinison
2018/0266103 A1 9/2018 Robinson
2018/0274228 A1* 9/2018 Robinson ..... E04B 1/6812
2018/0300490 A1 10/2018 Robinson
2018/0363292 A1 12/2018 Robinson
2018/0371746 A1 12/2018 Hensley et al.
2018/0371747 A1 12/2018 Hensley et al.
2019/0057215 A1 2/2019 Robinson
2019/0063608 A1 2/2019 Robinson et al.
2019/0071824 A1 3/2019 Robinson
2019/0107201 A1 4/2019 Robinson
2019/0108351 A1 4/2019 Robinson
2019/0194880 A1 6/2019 Robinson
2019/0194935 A1 6/2019 Robinson
2019/0211546 A1 7/2019 Hensley et al.
2019/0242070 A1 8/2019 Robinson
2019/0242117 A1 8/2019 Robinson
2019/0242118 A1 8/2019 Robinson
2019/0249420 A1 8/2019 Robinson
2019/0249421 A1 8/2019 Robinson
2019/0249422 A1 8/2019 Robinson
2019/0249423 A1 8/2019 Robinson
2019/0266335 A1 8/2019 Robinson
2019/0271150 A1 9/2019 Robinson
2019/0271151 A1 9/2019 Robinson
2019/0323347 A1 10/2019 Hensley et al.
2020/0018061 A1 1/2020 Robinson

* cited by examiner

JOINT SEAL WITH MULTIPLE COVER PLATE SEGMENTS

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to systems for creating a durable water-resistant seal in the joint between adjacent panels. More particularly, the present disclosure is directed to providing a durable expansion seal system having an elastically-compressive body, a first cover plate segment, a second cover segment, and one or more ribs.

Description of the Related Art

Construction panels come in many different sizes and shapes and may be used for various purposes, including roadways, sideways, tunnels and other pre-cast structures. Where the construction panels are concrete, it is necessary to form a lateral gap or joint between adjacent panels to allow for independent movement, such in response to ambient temperature variations within standard operating ranges. These gaps are also used to permit moisture to be collected and expelled. Cavity walls are common in masonry construction, typically to allow for water or moisture to condense or accumulate in the cavity or space between the two exterior walls. Collecting and diverting moisture from the cavity wall construction can be accomplished by numerous well-known systems. The cavity wall is often ventilated, such as by brick vents, to allow air flow into the cavity wall and to allow the escape of moisture heat or humidity. In addition to thermal movement or seismic joints in masonry walls, control joints are often added to allow for the known dimensional changes in masonry over time. Curtain wall or rain screen design is another common form of exterior cladding similar to a masonry cavity wall. Curtain walls can be designed to be primarily watertight but can also allow for the collection and diversion of water to the exterior of the structure. A cavity wall or curtain wall design cannot function as intended if the water or moisture is allowed to accumulate or condense in the cavity wall or behind a curtain wall or rain screen design cannot be diverted or redirected back to the outside of the wall. If moisture is not effectively removed it can cause damage ranging from aesthetic in the form of white efflorescence buildup on surface to mold and major structural damage from freeze/thaw cycling.

Thus, expansion and movement joints are a necessary part of all areas of construction. The size and location of the movement depends on variables such as the amount of anticipated thermal expansion, load deflection and any expected seismic activity. Joint movement in a structure can be cyclical in design as in an expansion joint or in as a control joint to allow for the shrinkage of building components or structural settling. These movement joints serve an important function by allowing a properly designed structure to move and the joint to cycle over time and to allow for the expected dimensional changes without damaging the structure. Expansion, control and movement joints are found throughout a structure from the roof to the basement, and in transitions between horizontal and vertical planes. It is an important function of these expansion joints to not only move as intended but to remain in place through their useful lifespan. This is often accomplished by extending the length and/or width of the expansion joint system over or past the edge of the gap or joint opening to attach to the joint substrate or another building component. Examples of building components that would ideal to integrally join an expansion joint with and seal would be, although not limited to, waterproofing membranes, air barrier systems, roofing systems and transitions requiring the watertight diversion of rain water. Although these joints represent only a small percentage of the building surface area and initial cost, they often account for a large percentage of waterproofing, heat loss, moisture/mold problems and other serious interior and exterior damage during the life of the building.

Conventional joint sealants like gunnable sealants and most foam seals are designed to hold the water out of the structure or expansion joint. However, water can penetrate the joint substrate in many ways such as cracks, poor sealant installation, roofing details and a porous substrate or wall component. When water or moisture enters the wall the normal sealing function of joint sealant may undesirably retain the moisture in the wall. Foam joint seals known in the art typically rely on the application of an elastomer sealant on the primary or exposed face of foam to provide the water-resistant function. Such joint seals are not waterproof but retard the penetration of water into the joint by providing a seal between adjacent substrates for a time and under a maximum pressure. Particularly, such joint seals are not waterproof—they do not preclude water penetration under all circumstances. While this is helpful initially to keep water out of the joint and structure it does not allow for this penetrating water or moisture to escape.

Further complicating operation, some wall designs, such as cavity walls, allow for moisture to enter a first wall layer where it collects and is then directed to the outside of the building by flashing and weep holes. In these systems, water can sometimes be undesirably trapped in the cavity wall, such as at a mortar bridge in the wall, or other impediment caused by poor flashing selection, design or installation. When a cavity wall drainage system fails, water is retained within the structure, leading to moisture accumulating within in the wall, and to an efflorescence buildup on the exterior of the wall. This can also result in freeze-thaw damage, among other known problems.

To be effective in this environment, fully functional, foam-based joint seals require a minimum compression ratio and impregnation density. It is known that higher densities and ratios can provide addition sealing benefits. Cost, however, also tends to increase with overall density. There is ultimately a trade-off between compression ratio/density range and reasonable movement capabilities at about 750 $kg/m^3$. As can be appreciated, this compressed density is a product of the uncompressed density of the material and the desired compression ratio to obtain other benefits, such as water resistance. For example, a foam having an uncompressed density of 150 $kg/m^3$ uncompressed and compressed at a 5:1 ratio results in a compressed density of 750 $kg/m^3$. Alternative uncompressed densities and compression ratios may reach that compressed density of 750 $kg/m^3$ while producing different mechanical properties. It has been long known in the art that a functional foam expansion joint sealant can be constructed using an uncompressed impregnated foam density range of about 80 kg/m$^3$ at a 5:1 compression ratio, resulting in a compressed density of 400 kg/m$^3$. This functional foam expansion joint sealant is capable of maintaining position within a joint and its profile while accommodating thermal and seismic cycling, while providing effective sealing, resiliency and recovery. Such joint seals are not fireproof but retard the penetration of fire into the joint by providing a seal which protects the adjacent substrates or the base of the joint for a time and under a maximum temperature. Particularly, such joint seals are not fireproof—they do not preclude the burning and decomposition of the foam when exposed to flame.

Another alternative known in the art for increasing performance is to provide a water resistant impregnated foam at a density in the range of 120-160 kg/m$^3$, ideally at 150 kg/m$^3$ for some products, with a mean joint size compression ratio of about 3:1 with a compressed density in a range of about 400-450 kg/m$^3$, although densities in a broader range, such as 45-710 kg/m$^3$ uncompressed and installed densities, after compression and installation in the joint, of 45 kg/m$^3$ and 1500 kg/m$^3$ may also be used. These criteria ensure excellent movement and cycling while providing for fire resistance according to DIN 4112-2 F120, meeting the Conditions of Allowance under UL 2079 for a two-hour endurance, for conventional depth, without loading, with one or more movement classifications, for a joint not greater than six inches and having a movement rating as great as 100%, without a hose stream test, and an ASTM E-84 test result with a Flame Spread of 0 and a Smoke Index of 5. This density range is well known in the art, whether it is achieved by lower impregnation density and higher foam compression or higher impregnation density and a lower compression ratio, as the average functional density required for an impregnated open cell foam to provide sealing and other functional properties while allowing for adequate joint movement up to +/−50% or greater. Foams having a higher uncompressed density may be used in conjunction with a lower compression ratio, but resiliency may be sacrificed. As the compressed density increases, the foam tends to retard water more effectively and provides an improved seal against the adjacent substrates. Additives that increase the hydrophobic properties or inexpensive fillers such as calcium carbonate, silica or alumina hydroxide (ATH) provided in the foam can likewise be provided in a greater density and become more effective. Combustion modified foams such as a combustion modified flexible polyurethane foam, combustion modified ether (CME) foam, combustion modified high resilience (CMHR) foam or combustion modified Viscoelastic foam (CMVE) can be utilized in the preferred embodiments to add significant fire resistance to the impregnated foam seal or expansion joint without adding additional fire-retardant additives. Foam that is inherently fire resistant or is modified when it manufactured to be combustion or fire-resistant reduces the cost of adding and binding a fire retardant into the foam. This method has been found to be advantageous in allowing fire resistance in foam seals configured in very high compression ratios such 5:1 and higher.

Current systems pre-compressed and compressible foam joint sealants and expansion joints use relatively large volumes of foam and silicone as part of their structure. It is known in the art that some products are supplied as a foam sealant without an additional coating with the functional features of the joint sealant system are supplied by the type of foam that is used, the type of binder and the type and quality of the additives in the impregnation compound. These systems work by filling or coating a varying percentage of the cells of the foam with the function filler by the impregnation, partial impregnation, surface impregnation, coating or by infusion such that they have varying degrees of hydrophobicity. The type of foam, density, cell structure, pore size, internal recovery force is known to vary depending the desired properties and would be known to one skilled in the art. Typical foams would polyether or polyester polyurethane foam but other foams with special properties such as melamine or silicone foams are advantageous for high fire-resistance. Higher quality foam and functional additives such as fire-resistant compounds increase the cost of the impregnation compound. Additionally, due to the foam sealant providing all of the functional properties of the system, higher compression ratios are often used to obtain adequate performance. The higher the compression ratio the more of the expensive foam and function binder and additives are used in the product increasing the cost. It is known that these systems can require a compression ratio from about 3:1 up to 8:1 from the uncompressed foam dimension. It is therefore desirable to reduce the ratio of the expensive functional foam and still provide the same function and features. Examples uncoated pre-compressed expanding foam joint sealants for movement joints are Sealtite by Schul International which has the waterproofing, fire-resistance, and UV stability provided by type and quality of the foam and the additives to the sealant binder without the need for an additional sealant or coating. This invention is not limited to precompressed foam sealants and should be obvious to one skilled in the art it would serve the same advantageous functions in a compressible foam joint sealant supplied in an uncompressed or partially compressed state.

It is known in the art to use a combination of a sealant and a foam to provide a hybrid joint sealant or expansion joint system. A representative product would be Seismic Sealtite II by Schul International. It is common in these systems to use silicone or other surface coating to provide some part of the functional feature of the system such as water resistance, UV stability, fire-resistance, chemical resistance, USDA/FDA allowance for food contact, color although not limited to these functions. These sealants or coatings typically add significant expense to these hybrid systems component of the impregnated foam systems. It would therefore be desirable to reduce the volume of surface coating required while still providing its intended function. Silicone had been found to be a preferred coating but the current invention is not limited to silicone coatings and would alternatively include hybrid gunnable sealants such as silicone-polyurethane, and other construction sealants and coatings such as polyurethane, polysulfide, acrylic, intumescent, fire-resistant, UV, mildew and other coatings that would add a useful hybrid function to the impregnated foam and known to those skilled in the art.

Further, conventional systems require the impregnated foam to be either coated at full width requiring a relatively high number of folds/bellows and a relatively higher compression ratio or partially compressed usually requiring fixtures which is cumbersome and time consuming and in a high compression ratio typically greater than 3:1 and often much higher. Higher compression with lower impregnation levels are known to allow for greater movement capabilities. Alternatively, it would be advantageous to allow for a higher level of functional fillers in a lower compression ratio foam to achieve the movement range of a higher compression ratio of foam and less functional filler. It is also recognized that the more a foam is compressed, the greater the damage to the foam cell structure, impacting the capability of the foam to recover. Further, the higher compression ratios increase the rate at which the primary surface coating of the foam would fatigue when bent into a tight fold or bellows. It would therefore be desirable to reduce the number of folds and the extent of compression during operation. Alternatives to reduce silicone, the ribs, and the extent of compression have been considered previously, but were found to require undesirable amounts of labor and preparation space. These have included, for example, partially compressing the impregnated foam joint seal before applying the silicone coating. It allows for high compression in a specific area of the foam expansion joint sealant reducing the required amount of foam impregnated with functional additives and sealant coating costs. This novel invention reduces the amount of foam required and eliminates the need for compression and coating fixture devices for systems that are coated in partial compression. This system saves time, space, labor, material while providing the same functionality as a partially compressed and coated system.

By selecting the appropriate additional component, the type of foam, the uncompressed foam density and the compression ratio, the majority of the cell network will be sufficiently closed to impede the flow of water into or through the compressed foam seal thereby acting like a closed cell foam. Beneficially, an impregnated or infused open cell foam can be supplied to the end user in a pre-compressed state in rolls/reels or sticks that allows for an extended release time sufficient to install it into the joint gap. To further the sealing operation, additional components may be included. For example, additives may be fully or partially impregnated, infused or otherwise introduced into the foam such that at least some portion of the foam cells are effectively closed, or a hydrophobic or water-resistant coating is applied. However, the availability of additional components may be restricted by the type of foam selected. Closed cell foams which are inherently impermeable for example, are often restricted to a lower joint movement range such as +/−25% rather than the +/−50% of open celled foams. Additionally, the use of closed cell foams restricts the method by which any additive or fillers can be added after manufacture. Functional features such as fire resistance to the Cellulosic time-temperature curve for two hours or greater can be however be achieved in a closed cell foam seal without impacting the movement properties. Intumescent graphite powder added to a polyethylene (PE), ethylene vinyl (EVA) acetate or other closed cell foam during processing in a ratio of about 10% by weight has been found to be a highly effective in providing flexible and durable water- and fire-resistant foam seal. While intumescent graphite is preferred, other fire retardants added during the manufacture of the closed cell foam are anticipated and the ratio of known fire retardants, added to the formulation prior to creating the closed cell foam, is dependent on the required fire resistance and type of fire retardant. Open celled foams, however, present difficulties in providing water-resistance and typically require impregnation, infusion or other methods for introducing functional additives into the foam. The thickness of a foam core or sheet, its resiliency, and its porosity directly affect the extent of diffusion of the additive throughout the foam. The thicker the foam core or sheet, the lower its resiliency, and the lower its porosity, the greater the difficulty in introducing the additive. Moreover, even with each of these at optimum, the additive will likely not be equally distributed throughout the foam but will be at increased density at the inner or outer portions depending on the impregnation technique.

A known solution in the art is the use of foam segments bonded together laterally to provide a lamination. However, such lateral laminations can separate from one another, creating fissures and openings for contaminates. Moreover, because the laminations are laterally positioned, the resulting pressure exerted by the joint seal against the adjacent substrates is a function of the combined densities and thicknesses and is constant at all heights of the substrate wall.

It is also known that the thin built-up lateral laminations must be adhesively bonded to avoid separation, and therefore failure, under thermal shock, rapid cycling or longitudinal shear. Because of the cost to effectively bond the lateral laminations, a cost/performance assessment sometimes produces laminations loosely held together by the foam compression rather than by an adhesive. While this is known in the art to be somewhat effective in low performance applications and OEM assembly uses, it also known that it cannot meet the demands of high movement seismic, shear, deflection joints or where fail-safe performance is required. In light of these issues, the preferred embodiment for a high movement impregnated foam expansion joint has been found to instead be a monolithic foam design comprised of a single impregnated foam core. However, lamination systems are often still considered desirable when the lamination adds a functional feature such as integrating a water-resistant membrane, a fire-resistant layer or other beneficial function.

Construction of lamination systems have typically been lateral composites considered undesirable or inferior for a high movement or rapid cycling fire resistant expansion joint sealant. The higher compression ratios and greater volumes of fire-retardant additives are likely to cause the foam to fatigue more rapidly and to lose much of its internal recovery force. This proves problematic over time due to the anticipated exposure to movement and cycling as the impregnated foam will tend to lose its recovery force and rely more on the push-pull connection to the joint substrate. When foam laminations are vertically-oriented, the laminations can de-bond or de-laminate and separate from one another, leading to only the outer most lamination remaining attached to the joint substrate, resulting in the laminated foam joint sealant ceasing to provide either water, air or fire resistance.

A known alternative or functional supplement to the use of various impregnation densities and compression ratios is the application of functional surface coatings such as water-resistant elastomers or fire-resistant intumescents, so that the impregnated foam merely serves as a "resilient backer". Almost any physical property available in a sealant or coating can be added to an already impregnated foam sealant layering the functional sealant or coating material. Examples would include but not limited to, fire ratings, waterproofing, color, UV resistance, mold and mildew resistance, soundproofing, impact resistance, load carrying capacity, faster or slower expansion rates, insect resistance, conductivity, chemical resistance, pick-resistance and others known to those skilled in the art. For example, a sealant or coating having a rating or listing for Underwriters Laboratories 2079 may be applied to an impregnated compressed foam to create a fire-resistant foam sealant.

One approach to addressing the shortcomings has been the creation of composite materials, where the foam core—whether solid or composed of laminations of the same or differing compositions—is coated or surface impregnated with a functional layer, so that the foam is merely a resilient backer for the sealant, intumescent or coating, such that the composition and density become less important. These coatings, and the associated properties, may be adhered to the surface of each layer of a core or layered thereon to provide multiple functional properties. As can be appreciated, the composite material may have different coatings applied the different sides to provide desired property or properties consistent with its position. Functional coatings such as a water-resistant sealant can protect the foam core from absorbing moisture even if the foam or foam impregnation is hydrophilic. Similarly, a functional coating such as a fire-rated sealant added to the foam core or lamination with protect a foam or foam impregnation that is flammable. A biocide may even be included. This could be layered, or on opposing surfaces, or—in the case of a laminate body—on perpendicular surfaces.

Additionally, it has become desirable, and in some situations required, for the joint sealant system to provide not only water resistance, but also fire resistance. A high degree of fire resistance in foams and impregnated foam sealants is well known in the art and has been a building code requirement for foam expansion joints in Europe for more than a decade. Fire ratings such as UL 2079, DIN 4112-2, BS 476, EN1399, AS1503.4 have been used to assess performance of expansion joint seals, as have other fire resistance tests and building codes and as the basis for further fire resistance assessments, the DIN 4112 standard, for example, is incorporated into the DIN 18542 standard for "Sealing of outside wall joints with impregnated sealing tapes made of cellular plastics—Impregnated sealing tapes". While each testing regime utilizes its own requirements for specimen preparation and tests (water test, hose stream tests, cycling tests), the 1998 version of UL 2079, the ISO 834, BS 476: Part 20, DIN 4112, and AS 1530.4-1995 use the Cellulosic time/temperature curve, based on the burning rate of materials found in general building materials and contents, which can be described by the equation $T=20+345*LOG(8*t+1)$, where t is time in minutes and T is temperature in C. While differing somewhat, each of these testing regimes addresses cycling and water resistance, as these are inherent in a fire-resistant expansion joint. The fire resistance of a foam sealant or expansion has been sometimes partially or fully met by infusing, impregnating or otherwise putting into the foam a liquid-based fire retardant, such as aluminum trihydrate or other fire retardants commonly used to add fire resistance to foam. Unfortunately, this increases weight, alters the foam's compressibility, and may not provide the desired result without additional fire-resistant coatings or additives if a binder, such as acrylic or polyurethane, is selected to treat the foam for fire and water resistance. Doing so while maintaining movement properties may affect the foam's compressibility at densities greater than 750 $kg/m^3$. Ultimately, these specialty impregnates and infused compositions increase product cost.

It has further become desirable or functionally required to apply a fire-resistant coating to the foam joint systems to increase fire and water resistance, but often at the sacrifice of movement. Historically, fire-resistant foam sealant products that use an additional fire-resistant surface coating to obtain the life safety fire properties have been limited to only +/−25% movement capability, especially when required to meet longer time-temperature requirements such as UL2079's 2 hour or longer testing. This +/−25% movement range is too limited for most movement joints and would not meet most seismic movement and expansion joint requirements. One well-known method for utilizing these low movement fire resistant joint sealants is to increase the width or size of the joint opening, an undesirable and expensive alternative, to allow for a commonly required +/−50% joint movement rating.

Unfortunately, supplying a pre-coated foam seal from the factory requires long leads times due to the required curing time, which can often hold up completion of projects in the final stages. This shortcoming is exacerbated if the composite material requires an additional functional layer to provide the desired properties. Installing the foam seal and adding another sealant in the field eliminates the one-step advantage of pre-compressed foam seals. The required multi-step process is labor and skill intensive and becomes even more challenging when the joint becomes greater than one inch, which pose difficulties for installation and to provide an aesthetically pleasing finished joint seal.

In certain circumstances, the expansion joint seal design must accommodate situations requiring the support of transfer loads have often required the use of rigid extruded rubber or polymer glands. These systems lack the resiliency and seismic movement required in expansion joints. These systems have been further limited in functioning as a fire-resistant barrier, which is often a desired function.

Other systems have incorporated cover plates that span the joint itself, often anchored to the concrete or attached to the expansion joint material and which are expensive to supply and install. These systems sometimes require potentially undesirable mechanical attachment, which requires drilling into the deck or joint substrate. Cover plate systems that are not mechanically attached rely on support or attachment to the expansion joint, thereby subjecting the expansion joint seal system to continuous compression, expansion and tension on the bond line when force is applied to the cover plate, which shortens the life of the joint seal system. Some of these systems use foam to provide sealing. But these foam systems can take on a compression set when the joint seal system is repeatedly exposed to lateral forces from a single direction, such as a roadway. This becomes more pronounced as these foam systems utilize a single or continuous spine along the length of the expansion joint seal system—which propagates any deflection along the length. The problems and limitations of the current foam sealing cover plate systems that rely on a continuous spline are well known in the art.

These cover plate systems are designed to address lateral movement—the expansion and compression of adjacent panels. Unfortunately, these do no properly address vertical shifts—where the substrates become misaligned when the end of one shifts vertically relative to the other. In such situations, the components attached to the cover plate are likewise rotated in space causing a pedestrian or vehicular hazard. The inability of the current art to compensate for the lateral or thermal movement of the cover plate results in failure of attachment to the cover plate or additional pressure being imposed on one half of the expansion joint system and potentially pulling the expansion joint system away from the lower substrate.

It would be an improvement to the art to provide an expansion joint seal incorporating a multicomponent cover plate and associated rib which maintains flexibility while providing impermeability, particularly where the compressibility, density, and spring force may vary across the entirety of the expansion joint seal.

SUMMARY

The present disclosure therefore meets the above needs and overcomes one or more deficiencies in the prior art. An expansion joint seal is provided which includes an elastically-compressive body, a first cover plate segment, a second cover plate segment, and at least one rib. The elastically compressive body has a body first side surface, a body second side surface, a body centerline intermediate the body first side surface and the body second side surface, a body first side width from the body first side surface to the body centerline, a body second side width from the body second side surface to the body centerline, a body top surface extending from the body first side surface to the body seconds side surface, a body first end, a body second end, and a body longitudinal axis from the body first end to a body second. The first cover plate segment is positioned above the elastically-compressible body and adjacent the body top surface and has a first cover plate segment first side surface positioned between the body first side surface and the body centerline. The first cover plate segment has a first cover plate width greater than the body first side width and extends beyond the body first side surface. The second cover plate segment is positioned above the elastically-compressible body and is adjacent the body top surface. The second cover plate segment has a second cover plate segment first side surface positioned between the body second side surface and the body centerline, a width greater than the body second side width, and extends beyond the body second side surface. One or more ribs penetrate into the elastically-compressive body from above the body top surface and therefore provide a point of connection between the first cover segment, the second cover segment and the elastically-compressive body. The first cover segment is therefore fixed in relation to the one or more ribs and the second cover segment is likewise fixed in relation to the one or more ribs.

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

The present disclosure provides a durable expansion joint seal which includes an elastically-compressive body, a first cover plate segment, a second cover segment, and one or more ribs which provide a seal against water when inserted between substrates and permitted to expand to fit the gap between them.

Figure 1:
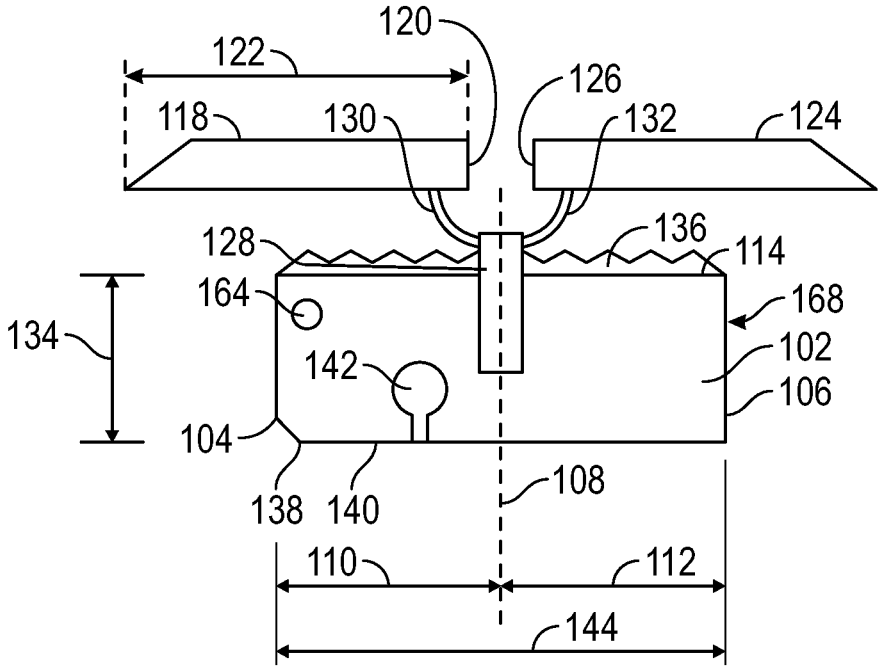
FIG. 1 illustrates an end view of the present disclosure.

Referring to FIG. 1, an end view of the present disclosure is provided. The expansion joint seal 100 includes an elastically-compressive body 102, a first cover plate segment 118, a second cover plate segment 124, and one or more ribs 128.

Figure 2:
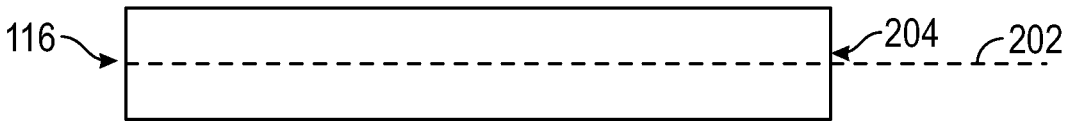
FIG. 2 illustrates a top view of the present disclosure.
Figure 3:
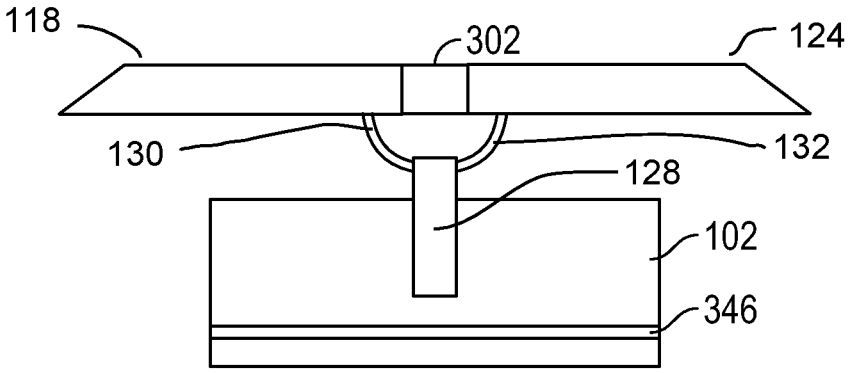
FIG. 3 illustrates an end view of a further embodiment of the present disclosure.

Referring to FIG. 1, and FIG. 2, which discloses a top view of the expansion joint seal 100, the expansion join seal 100 is disclosed. The elastically-compressive body 102 has a body first side surface 104, a body second side surface 106, a body centerline 108 intermediate the body first side surface 104 and the body second side surface 106, a body first side width 110 from the body first side surface 104 to the body centerline 108, a body second side width 112 from the body second side surface 106 to the body centerline 108, a body top surface 114 extending from the body first side surface 104 to the body seconds side surface 106, a body first end 116, a body second end 204, a body longitudinal axis 202 from the body first end 116 to a body second 204. The first cover plate segment 118 is positioned above the elastically-compressible body 102 and is adjacent the body top surface 114. The first cover plate segment 118 has a first cover plate segment first side surface 120 positioned between the body first side surface 104 and the body centerline 108. The first cover plate segment 118 further has a first cover plate width 122 greater than the body first side width 110 and extends beyond the body first side surface 104. The second cover plate segment 124 is positioned above the elastically-compressible body 102 and adjacent the body top surface 114. The second cover plate segment 124 has a second cover plate segment first side surface 126 positioned between the body second side surface 106 and the body centerline 108. The second cover plate segment 124 further has a width greater than the body second side width 112 and extends beyond the body second side surface 106. Notably, neither of the first cover plate segment cover 118 nor the second cover plate segment cover 124 spans the entirety of the elastically-compressible body 102. The one or more ribs 128 penetrate into the elastically-compressive body from above the body top surface. The first cover segment 118 is fixed in relation to the one or more ribs 128 and the second cover segment 124 fixed in relation to the one or more ribs 128. The first cover plate segment cover 118 and the second cover plate segment cover 124 in this embodiment are attached to the same rib 128. The first cover plate segment first side surface 120 may abut the second cover plate segment 124. Referring to FIG. 3, an end view of a further embodiment of the present disclosure, and FIG. 4, an end view of another embodiment of the present disclosure, when desired, the first cover segment 118 and the second cover segment 124 may be connected to the same one of the one or more ribs 128 or may be affixed to a rubber seal 302 or to a member 402. When desired, the one or more ribs 128 may be attached to the associated first cover segment 118 and second cover segment 124 by a tether 130, 132. The tether 130, 132, may be selected from available materials, and may include plastic fibers, polypropylene rope, or metal ribbons, among others. The tethers 130, 132 may be selected to fail upon application of a maximum force, ensuring that a strike, such as by a plow, will cause the first cover segment 118 and/or second cover segment 124 to rip away, but leave the balance of the joint seal intact. Alternatively, each of the first cover segment 118 and second cover segment 124 may be connection directly to a rib, which may be the same rib, by a flexible or hinged connection to permit movement of each relative to the elastically-compressive body 102.

The elastically-compressive body 102 may be selected of a resiliently-compressible material or composite and may be lamination which includes laminates of materials which have differing compressibilities or even may include a layer which is incompressible. The elastically-compressive body 102 presents a generally rectangular shape, but may be a hexagon, octogon, or more complex shape. The shapes may be regular or irregular.

Figure 6:
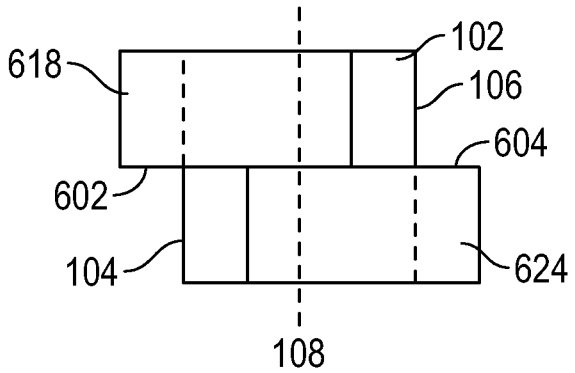
FIG. 6 illustrates a top view of an additional alternative embodiment is illustrated.

Referring to FIG. 6, a top view of an additional alternative embodiment is illustrated. The first cover segment 618 may have a first cover segment front surface 602 and the second cover segment 624 may have a second cover segment rear surface 604, where the first cover segment 618 and the second cover segment 624 are adjacent along the longitudinal axis, and the first cover segment front surface 602 and the second cover segment rear surface 604 may be partially adjacent.

In use, the joint seal 100 is positioned between substrates in compression and maintains compression to seal against external solids and liquids. To enable installation of the joint seal 100 between the substrates, the joint seal 100 is compressed below the joint size. During operation, the joint seal 100 is often in compression at one-third to one-sixth its original size. A greater compression for delivery permits the product to be removed from packaging and installed before the joint seal 100 relaxes to a width greater than the expansion joint gap size between substrate walls.

Because the joint seal 100 is in compression between the substrates of an expansion joint, it is well-known to pre-compress the joint seal 100 at the factory and provide the joint seal 100 in compression. To prepare the joint seal 100 for delivery, it is often desirable to compress the joint seal 100 to an even smaller portion of its original size and then to include one or more packaging members to provide rigidity and/or non-stick surface against the surrounding packaging, such as shrink wrap.

Figure 7:
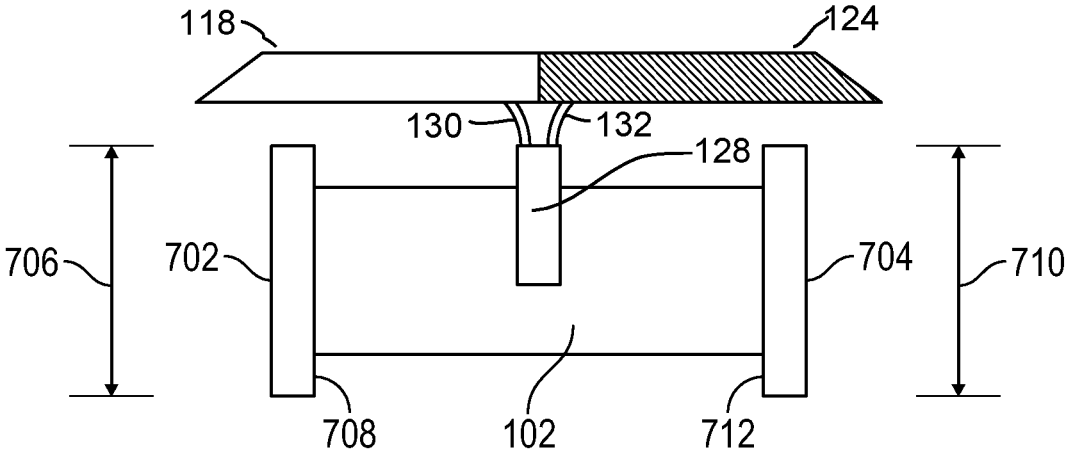
FIG. 7 illustrates an end view of the present disclosure with packaging bodies.

Referring to FIG. 7, an end view of a joint seal 100 with two packaging bodies 702, 704 is illustrated prior to compression. The packaging body 702, 704 may be a board of any durable material, including wood and plastic, or may be a thin plastic liner. The first packaging body 702 has a first packaging body height 706, and a first packaging body first surface 708. The first packaging body height 706 is preferably equal to, though it may be greater or less than, the elastically-compressive body height 134. The first packaging body first surface 708 is adapted to contact the body first side surface 104. The second packaging body 704 has a second packaging body height 710 and a second packaging body first surface 712. The second packaging body height 710 is preferably equal to, though it may be greater or less than, the elastically-compressive body height 134. The packaging body 702, 704 may be provided with a surface facing the elastically-compressive body 102 which deters adhesion to facilitate later removal from the packaging for installation between substrates.

Figure 8:
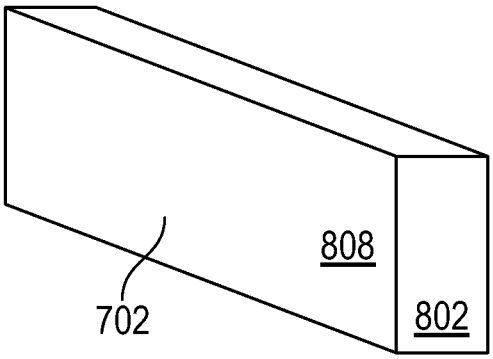
FIG. 8 illustrates an isometric view of the rear of a packaging body.

Referring to FIG. 8, an isometric view of the rear of a first packaging body 702 is provided. The first packaging body 702 includes a packaging body first surface 808 and has a packaging body rear surface 802. The first packaging body 702 may be a rectangular prism as illustrated in FIGS. 7 and 8 or may, when desired, be of a different shape. For example, the first packaging body 702 may have a conic or cylindrical shape, which may be beneficial in reducing areas of stress concentration in any tensioned packaging, such as shrink wrap.

The joint seal 100 is provided for installation in compression. The first packaging body 702, any second packaging body 704, and the various bodies are laterally compressed, to the extent each is compressible. The joint seal 100 is then packaged, such as in shrink wrap, to remain in compression. After the first packaging body 702, and any second packaging body 704, is removed, the joint seal 100 is imposed between the first substrate and the second substrate before relaxing to a width greater than the expansion joint. The joint seal 100 continues to relax and contacts the substrate walls and is maintained in compression in the joint, and, by virtue of its nature, inhibits the transmission of water or other contaminants further into the expansion joint. The joint seal 100 may be adhered to the substrate walls by an adhesive on the sides of the core bodies. When desired a second packaging body may be provided on the opposing side of the joint seal 100.

The elastically-compressive body 102 may be a foam member or may be a non-foam material which exhibits properties of compressibility, expansion, resiliency, and to support liquid-based additives, such a fire retardants and fillers. These may be a core, such as rubber or cellulose or other material, or may be composed of a foam, such as an open-celled polyurethane foam. These may have an overall length sufficient for use on site, eliminating any need for a splice to join to an adjacent joint seal 100. The joint seal 100 is sized to fit between two panels or substrates and may be adjusted in width and height to accommodate the intended lateral movement and provide sufficient benefits.

When the elastically-compressive body 102 is to be constructed of foam, any of various types of foam known in the art may be, including compositions such as polyurethane and polystyrene, and may be open or closed cell. The uncompressed density of the elastically-compressive body 102 may also be altered for performance, depending on local weather conditions. The density of the elastically-compressive body 102 when relaxed and prior to any compression may be less 400 kg/m$^3$. The composition of the elastically-compressive body 102 may be selected of a composition which is fire retardant or water resistant.

The elastically-compressive body 102 may be a foam, such as an open cell foam, a lamination of open cell foam and closed cell foam, and closed cell foam. When desired, the elastically-compressive body 102 may have a treatment, such as impregnation, to increase desirable properties, such as fire resistance or water resistance, by, respectively, the introduction of a fire retardant into the foam or the introduction of a water inhibitor into the foam. Further, a the elastically-compressive body 102 may be composed of a hydrophilic material, a hydrophobic material, a fire-retardant material, or a sintering material.

The elastically-compressive body 102 may be formed of commercially available vapor permeable foam products or by forming specialty foams. Commercial available products which provide vapor permeable and excellent fire-resistant properties are well known, such as Sealtite VP or Willseal 600. It is well known that a vapor-permeable but water-resistant foam joint sealant may be produced leaving at least a portion of the cell structure open while in compression such that water vapor can escape through the impregnated foam sealant. Water is then ejected on the exterior of the joint seal 100 because the foam, and/or any impregnation, is hydrophobic and therefore repels water. Water can escape from the foam sealant or wall cavity through water vapor pressure by virtue of the difference in humidity creating unequal pressure between the two areas. Because the cell structure is still partially open the vapor pressure drive is sufficient to allow moisture to return to equalization or the exterior of the structure. By a combination of compression ratio and impregnation density of a hydrophobic component the water resistance capacity can be increased to provide resistance to various levels of pressure or driving rain.

Moreover, the material for the elastically-compressive body 102 may be selected from partially closed cell or viscoelastic foams. Most prior art foams seals have been designed as "soft foam" pre-compressed foam seals utilizing low to medium density foam about 16-30 kg/m3 and softer foam ILD range of about 10-20. It has been surprisingly found through extensive testing of variations of foam densities and foam hardness, fillers and elastic impregnation compounds that higher density "hard" foams with high ILD's can provide an effective foam seal meeting the required waterproofing 600 Pa minimum and ideally 1000 Pa or greater and movement and cycling requirements such as ASTM E-1399 Standard Test Method for Cyclic Movement and Measuring the Minimum and Maximum Joint Widths of Architectural Joint Systems as well as long term joint cycling testing. An advantage has been found in using higher density and higher hardness higher ILD foams particularly in horizontal applications. While at first this might seem obvious it is known in the art that higher density foams that are about 32-50 kg/m3 with an ILD rating of about 40 and greater tend to have other undesirable properties such as a long term decrease in fatigue resistance. Desirable properties such as elongation, ability to resist compression set, foam resiliency and fatigue resistance typically decline relative to an increase in density and ILD. These undesirable characteristics are often more pronounced when fillers such as calcium carbonate, melamine and others are utilized to increase the foam density yet the cost advantage of the filled foam is beneficial and desirable. Similarly, when graft polyols are used in the manufacture of the base foam to increase the hardness or load carrying capabilities, other desirable characteristics of the base foam such as resiliency and resistance to compression set can be diminished. Through the testing of non-conventional impregnation binders and elastomers for pre-compressed foam sealants such as silicones, urethanes, polyureas, epoxies, and the like, it has been found that materials that have reduced tack or adhesive properties after cure and which provide a high internal recovery force can be used to counteract the long-term fatigue resistance of the high density, high ILD foams. Further, it has been found that by first impregnating and curing the foam with the injected or impregnated silicone, acrylic, urethane or other low tack polymers and, ideally, elastomers with about 100-199% elongation or greater providing a sufficient internal recovery force, that it was additionally advantageous to re-impregnate the foam with another elastomer or binder to provide a timed expansion recovery at specific temperatures. The impregnation materials with higher long-term recovery capabilities imparted to the high density, high ILD base foams, such as a silicone or urethane elastomers, can be used to impart color to the foam seal or be a clear or translucent color to retain the base foam color. If desirable a second impregnation, partial impregnation or coating can be applied to or into the foam seal to add additional functional characteristics such as UV stability, mold and mildew resistance, color, fire-resistance or fire-ratings or other properties deemed desirable to functionality to the foam.

Viscoelastic foams have not typically been commercially available or used for foam seals due to perceived shortcomings. Commonly used formulations, ratios and methods do not provide a commercially viable foam seal using viscoelastic foam when compared to standard polyurethane foams. Open cell viscoelastic foams are more expensive than polyester or polyether polyurethane foams commonly used in foam seals. Any impregnation process on a viscoelastic foam tends to proceed slower than on a traditional foam due to the fine cell structure of viscoelastic foam. This can be particularly frustrating as the impregnation materials and the impregnation process are typically the most expensive component of a foam seal. However, because of their higher initial density viscoelastic foams can provide better load carrying or pressure resistant foam seal. Both properties are desirable but not fully provided for in the current art for use in applications such as load carrying horizontal joints or expansion joints for secondary containment. Common densities found in viscoelastic foams are 64-80 kg/m$^3$ or greater. Additionally, viscoelastic foams have four functional properties density, ILD rating, temperature and time compared to flexible polyurethane foams, which have two primary properties density and an ILD rating.

However, the speed of recovery of viscoelastic foams following compression may be increased by reducing or eliminating any impregnation, surface impregnation or low adhesive strength impregnation compound. Incorporating fillers into the impregnation compound is known to be effective in controlling the adhesive strength of the impregnation binder and therefore the re-expansion rate of the impregnated foam. By surface impregnating or coating the outside surface of one or both sides of viscoelastic foam to approximately 10% of the foam thickness, such as about 3-8 mm deep for conventional joint seals, the release time can be controlled and predicted based on ambient temperature. Alternatively, the foam can be infused, partially impregnated or impregnated with a functional or non-functional filler without a using binder but rather only a solvent or water as the impregnation carrier where the carrier evaporates leaving only the filler in the foam.

The re-expansion rate of a seal using viscoelastic foam may be controlled by using un-impregnated viscoelastic foam strips and re-adhering them with a pressure sensitive adhesive or hot melt adhesive. When the seal is compressed, the laminating adhesive serves as a temporary restriction to re-expansion allowing time to install the foam seal. Viscoelastic foam may be advantageously used, rather than standard polyurethane foam, for joints requiring additional softness and flexibility due to higher foam seal compression in hot climates or exposure or increased stiffness in cold temperatures when a foam seal is at its minimum compressed density. Additionally, closed cell, partially closed cell and other foams can be used as in combination with the viscoelastic foams to reduce the overall cost.

This second group of body materials, the non-foam members, may include, for example, corrugated cardboards, natural and man-made batting materials, and natural, synthetic and man-made sponge material. When desired, such materials may be selected for properties, such as water leakage, air leakage, resilience in face of one or more cycling regimes, compressibility, relaxation rate, compression set, and elasticity.

The material for the elastically-compressive body 102 may be altered to provide additional functional characteristics. It may be infused, impregnated, partially impregnated or coated with an impregnation material or binder that is designed specifically to provide state of the art seal water-resistance properties with a uniform and consistent distribution of the waterproofing binder. The elastically-compressive body 102 may also, or alternatively, be infused or impregnated or otherwise altered to retain a fire retardant, dependent on function. Where the elastically-compressive body 102 is foam, any suitable open cell foam type with a density of 16-45 kg/m$^3$ or higher can provide an effective water-resistant foam-based seal by varying the impregnation density or the final compression ratio. Where a sound resistant seal is desired, the density or the variable densities provide a sound resistant seal in a similarly-rated wall from a Sound Transmission Class value from 42-63 and/or a sound reduction between 12 and 50 decibels.

The elastically-compressive body 102 may be selected from an inherently hydrophilic material or have a hydrophilic component such as a hydrophilic polymer that is uniformly distributed throughout. The elastically-compressive body 102 may include strategically-placed surface impregnation or partially impregnate with a hydroactive polymer. Because the primary function of the joint seal 100 is waterproofing, the addition of a hydrophilic function does not negatively impact any desired fire-resistant properties, as an increased moisture content, and may increase fire resistive properties.

Other variations may be employed. The joint seal 100 may be constructed to withstand a hydrostatic pressure equal to or greater than 29.39 psi. Environmentally friendly foam, fillers, binders, elastomer and other components may be selected to meet environmental, green and energy efficiency standards. The elastically-compressive body 102 may exhibit auxetic properties to provide support or stability for the joint seal 100 as it thermally cycles or to provide additional transfer loading capacity. Auxetic properties may be provided by the material selected for the elastically-compressible body 102, the internal components such as the members/membrane or by an external mechanical mechanism.

The elastically-compressive body 102 may include an impregnate, such as a fire retardant such as aluminum trihydroxide, which may be throughout its entirety or which may be only about ten percent of it from one surface to the opposing surface. Additional function properties can be added by surface impregnating the exposed or outside surfaces of the foam as well as the inside portion if additional properties are desirable. The elastically-compressive body 102 may contain, such as by impregnation or infusion, a sintering material, wherein the particles in the impregnate move past one another with minimal effort at ambient temperature but form a solid upon heating. Once such sintering material is clay or a nano-clay. Such a sintering impregnate would provide an increased overall insulation value and permit a lower density at installation than conventional foams while still having a fire endurance capacity of at least one hour, such as in connection with the UL 2079 standard for horizontal and vertical joints. While the cell structure, particularly, but not solely, when compressed, of the elastically-compressive body 102, preferably inhibits the flow of water, the presence of an inhibitant or a fire retardant may prove additionally beneficial. The fire retardant may be introduced as part of the foaming process, or by impregnating, coating, infusing, or laminating, or by other processes known in the art. The joint seal 100 may be provided with end profiles intended to provide interlocking faces so a plurality of joint seal 100 may be installed in abutment.

Figure 5:
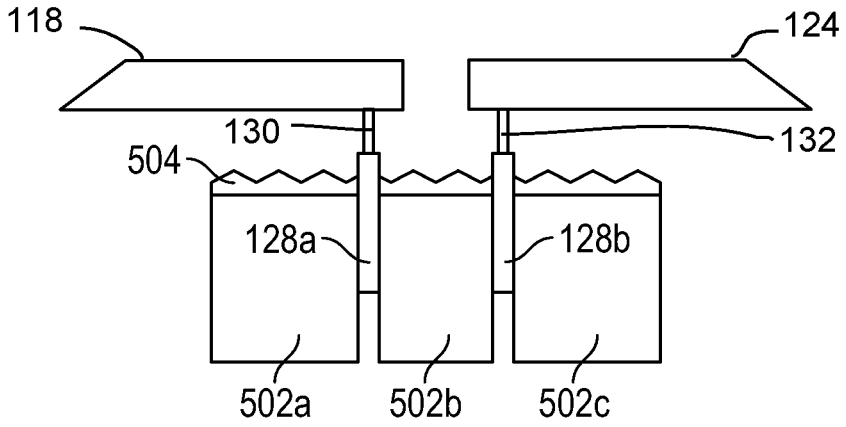
FIG. 5 illustrates an alternative embodiment of the present disclosure.

Referring to FIG. 5, an alternative embodiment of the present disclosure is provided. When desired, the expansion joint seal 100 may include an elastically-compressive body 102, a first cover plate segment 118, and a second cover plate segment 124. The elastically compressive body 102 has three body members 502*a*, 502*b*, 502*c* interspersed with two ribs 128*a*, 128*b*, a body first side surface 104, a body second side surface 106, a body centerline 108 intermediate the body first side surface 104 and the body second side surface 106, a body first side width 110 from the body first side surface 104 to the body centerline 108, a body second side width 112 from the body second side surface 106 to the body centerline 108, a body top surface 114 extending from the body first side surface 104 to the body seconds side surface 106, a body first end 116, a body second end 204, and a body longitudinal axis 202 from the body first end 116 to a body second 204. The first cover plate segment 118 is positioned above the elastically-compressible body 102 and is adjacent the body top surface 114. The first cover plate segment 118 has a first cover plate segment first side surface 120 positioned between the body first side surface 104 and the body centerline 108, a first cover plate width 122 greater than the body first side width 110, and extends beyond the body first side surface 104. The second cover plate segment 124 is positioned above the elastically-compressible body 102 and is adjacent the body top surface 114 and has a second cover plate segment first side surface 126 positioned between the body second side surface 106 and the body centerline 108, a width greater than the body second side width 112, and extends beyond the body second side surface 106. The first cover segment 118 fixed in relation to a first of the two ribs 128*a* while the second cover segment 124 fixed in relation to a second of the two ribs 128*b*. Referring to FIG. 3, the first cover segment 118 and the second cover segment 124 may each be affixed to a rubber seal 302 or to a third member 402.

Referring to FIGS. 1 and 5, a coating 136, 504 may be applied across the joint seal 100 across the body top surface 114. Where the coating 136, 504 provides fire resistance, the elastically-compressible body 102 may be provided without a fire retardant. The coating 136, 504 may further include an insulating layer, such as a silicate, to add a refractory of insulating function. However, such a layer, unless otherwise selected, would not be a fire-retardant liquid glass formulation. The coating 136, 504 may include a flexible or semi-rigid elastomer to increase load carrying capability which is further enhanced by the supporting intumescent members. These, or other coatings, may be used to provide waterproofing, fire resistance, or additional functional benefits. Such coatings are known in the art, such as Dow 790.

The coating 136, 504 may undergo chemical reaction when heated to reduce flammability or delay combustion or cool through physical action or endothermic reactions. The coating 136, 504 may provide retardancy through endothermic degradation, such as by use of aluminum hydroxide. Coating 136, 504 may provide retardancy through thermal shielding, such as by use of an intumescent, which chars over when burned, separating the flame from the material and slowing heat transfer. The coating 136, 504 may provide retardancy by gas phase radical quenching, such as when chlorinated paraffin undergoes thermal degradation and releases hydrogen chloride to lower potential propagation of combustion reactions. The coating 136, 504 may extend down around the joint seal 100. In a further alternative, the coating 136, 504 may an elastomeric gland.

When desired, the joint seal 100 may be structured to aid in installation by beveling its bottom. The joint seal 100 may include a body beveled surface 138 intermediate the body first side surface 104 and the bottom surface 140. Additionally or alternatively, the joint seal 100 may further include one or more openings 142 at any of the bottom surface 140, penetrating upward and becoming wider as it penetrates further, such as by an initially rectangular prism opening coupled with a cylindrical opening, which permits movement and compression of the elastically-compressible body 102 but limits, particularly at the bottom surface 140, the extent of such movement. When desired, a structural member, such as a load transfer member or an intumescent rod or other shape may be imposed in each opening 142.

Further structural elements may be incorporated to increase the fire resistance of the joint seal 100. Thus, the joint seal 100 may include an intumescent member 164 in elastically-compressible body 102. Additionally, or alternatively, an intumescent body 168 may be imposed within the elastically-compressible body 102 or in a channel found on an exterior surface. The intumescent body 168 may provide both fire retardancy and may extend beyond the joint seal 100 to overlap and join and adjacent joint seal 100.

Referring to FIG. 3, the elastically-compressible body 102 may include, within and across its height or width a membrane 346. The membrane 346 may be a vapor-impermeable layer. The membrane 346 may provide a barrier to foreign matter penetrating through the joint seal 100 and to opposing surface of the joint, thus ensuring some portion of the core bodies are not susceptible to contaminants and therefore continue to function. The membrane 346 may thus may retain and then expel moisture, preventing moisture from penetrating in an adjacent substrate. As can be appreciated, to be effective, the membrane 346 is preferably sized to have a length at least equivalent to the elastically-compressible body width 144, the sum of body first side width 110 and the body second side width 112, into which it is placed, though it may be smaller or greater. Alternatively, the membrane 346 may extend beyond the core bodies to provide a surface which may contact an adjacent substrate and even overlap its top. The membrane 346 may be intumescent or may otherwise provide fire retardancy in the joint seal 100.

Figure 4:
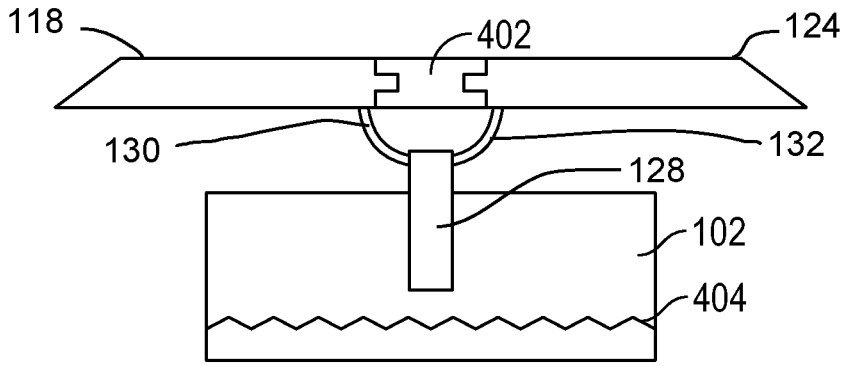
FIG. 4 illustrates an end view of another embodiment of the present disclosure.

Referring to FIG. 4, the joint seal 100 may further include a spring member 404, the spring member 404 presenting a wave-like profile and having a spring member spring force positioned in the elastically-compressible body 102. When desired, the spring member 404 may have an intumescent or fire retarding coating or composition.

Finally, to ensure an anchor to the substrate, an adhesive may be applied to the body first side surface 104. Moreover, an intumescent rod 164 or other shape may be imposed within the joint seal 100 and may also provide a key for splicing to an adjacent joint seal 100. Beneficially, where the intumescent rod 164 extends beyond a first end of the joint seal 100, it may be used to provide a splice connection to an adjacent joint seal 100.

Figure 9:
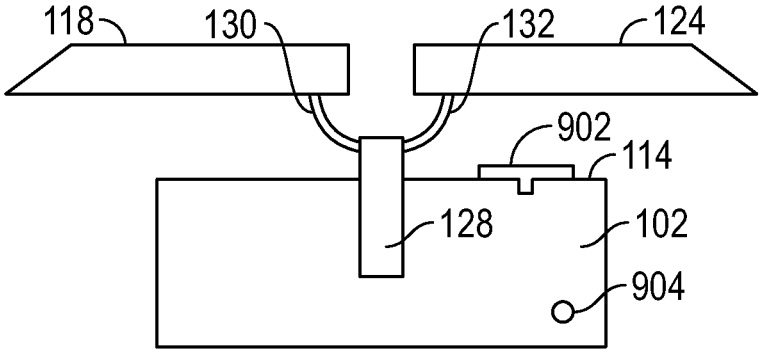
FIG. 9 illustrates an alternative further embodiment of the present disclosure.

Referring to FIG. 9, other mechanical benefits can be incorporated into the joint seal 100, such as a load transfer member 902 positioned on or below, i.e. adjacent, the body top surface 114 of the 102 which distributes any load applied to the body top surface 114 of the elastically-compressible body 102 across a greater surface area of the elastically-compressible body 102. The load transfer member 902 may composed of any durable material, including plastics, metals, or composites with its own spring force. The load transfer member 902 may be provided with mechanical properties, such as fire resistance, and may be intumescent.

Additionally, when desired, a sensor 904 may be included and may contact one of more of the component of the joint seal 100. The sensor 904 may be a radio frequency identification device RFID or other wirelessly transmitting sensor. A sensor may be beneficial to assess the health of a joint seal 100 without accessing the interior of the expansion joint, otherwise accomplished by removal of the cover plate. Such sensors are known in the art, and which may provide identification of circumstances such as moisture penetration and accumulation. The inclusion of a sensor 904 in the joint seal 100 may be particularly advantageous in circumstances where the joint seal 100 is concealed after installation, particularly as moisture sources and penetration may not be visually detected. Thus, by including a low cost, moisture-activated or sensitive sensor, the user can scan the joint seal 100 for any points of weakness due to water penetration. A heat sensitive sensor may also be positioned within the joint seal 100, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor 904 in the joint seal 100 may provide substantial benefit for information feedback and potentially activating alarms or other functions within the joint seal 100 or external systems. Fires that start in curtain walls are catastrophic. High and low-pressure changes have deleterious effects on the long-term structure and the connecting features. Providing real time feedback and potential for data collection from sensors, particularly given the inexpensive cost of such sensors, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. Additionally, a sensor 904 could be selected which would provide details pertinent to the state of the Leadership in Energy and Environmental Design LEED efficiency of the building. Additionally, such a sensor, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor 904 may be positioned in other locations within the joint seal 100 to provide beneficial data. A sensor 904 may be positioned to provide prompt notice of detection of heat outside typical operating parameters, so as to indicate potential fire or safety issues. Such a positioning would be advantageous in horizontal of confined areas. A sensor 904 so positioned might alternatively be selected to provide moisture penetration data, beneficial in cases of failure or conditions beyond design parameters. The sensor 904 may provide data on moisture content, heat or temperature, moisture penetration, and manufacturing details. A sensor 904 may provide notice of exposure from the surface of the joint seal 100 most distant from the base of the joint. A sensor 904 may further provide real time data. Using a moisture sensitive sensor in the joint seal 100 and at critical junctions/connections would allow for active feedback on the waterproofing performance of the joint seal 100. It can also allow for routine verification of the watertightness with a hand-held sensor reader to find leaks before the reach occupied space and to find the source of an existing leak. Often water appears in a location much different than it originates making it difficult to isolate the area causing the leak. A positive reading from the sensor alerts the property owner to the exact locations that have water penetration without or before destructive means of finding the source. The use of a sensor 904 in the joint seal 100 is not limited to identifying water intrusion but also fire, heat loss, air loss, break in joint continuity and other functions that cannot be checked by non-destructive means. Use of a sensor 904 within the joint seal 100 may provide a benefit over the prior art. Impregnated foam materials, which may be used for the elastically-compressible body 102 are known to cure fastest at exposed surfaces, encapsulating moisture remaining inside the elastically-compressible body 102, and creating difficulties in permitting the removal of moisture from within the elastically-compressible body 102. While heating is a known method to addressing these differences in the natural rate of cooling, it unfortunately may cause degradation of the foam in response. Similarly, while forcing air through the elastically-compressible body 102 may be used to address the curing issues, the potential random cell size and structure impedes airflow and impedes predictable results. Addressing the variation in curing is desirable as variations affect quality and performance properties. The use of a sensor 904 within the joint seal 100 may permit use of the heating method while minimizing negative effects. The data from the sensors, such as real-time feedback from the heat, moisture and air pressure sensors, aids in production of a consistent product. Moisture and heat sensitive sensors aid in determining and/or maintaining optimal impregnation densities, airflow properties of the foam during the curing cycle of the foam impregnation. Placement of the sensors 904 into foam at the pre-determined different levels allows for optimum curing allowing for real time changes to temperature, speed and airflow resulting in increased production rates, product quality and traceability of the input variables to that are used to accommodate environmental and raw material changes for each product lots.

The selection of components providing resiliency, compressibility, water-resistance and fire resistance, the joint seal 100 may be constructed to provide sufficient characteristics to obtain fire certification under any of the many standards available. In the United States, these include ASTM International's E 814 and its parallel Underwriter Laboratories UL 1379 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multistory Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." Combustibility, ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG 8*t+1 where t is time, in minutes, and T is temperature in degrees Celsius including E 814/UL 1379 and E 1966/UL 2079.

E 814/UL 1379 tests a fire-retardant system for fire exposure, temperature change, and resilience and structural integrity after fire exposure the latter is generally identified as "the Hose Stream test". Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1379 listing, it must pass both the fire endurance F rating and the Hose Stream test. The temperature data is only relevant where building codes require the T to equal the F-rating.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure kPa | Duration of Hose Stream Test sec./$m^2$ |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1379 and UL 2079 also provide for air leakage and water leakage tests, where the rating is made in conjunction with a L and W standard. These further ratings, while optional, are intended to better identify the performance of the system under fire conditions.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure STP conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Nonhardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72-hour assessment.

Another frequently encountered classification is ASTM E-84 also found as UL 723 and NFPA 255, Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-199 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall head-of-wall joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification if used | Minimum number of cycles | Minimum cycling rate cycles per minute | Joint Type if used |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated.

The joint seal 100 may therefore perform wherein the bottom surface 140 of the joint seal 100 at a maximum joint width increases no more than 181° C. after sixty minutes when the joint seal 100 is exposed to heating according to the equation T=20+345*LOG 8*t+1, where t may be time in minutes and T may be temperature in C.

The joint seal 100 may also perform wherein the bottom surface 140 of the joint seal 100, having a maximum joint width of more than six inches, increases no more than 139° C. after sixty minutes when the joint seal 100 is exposed to heating according to the equation T=20+345*LOG 8*t+1, where t may be time in minutes and T may be temperature in C.

The joint seal 100 may be adapted to be cycled one of 500 times at 1 cycle per minute, 500 times at 10 cycles per minute and 100 cycles at 30 times per minute, without indication of stress, deformation or fatigue.

In other embodiments, the joint seal 100 is configured to pass hurricane force testing to TAS 202/203. Further the joint seal 100 may be designed or configured to pass ASTM E-282, E-331, E-330, E-547 or similar testing to meet the pressure cycling and water resistance requirements up to 5000 Pa or more.

The present disclosure thus provides a dimensional stability, as a result of the reduction of main foam, while requiring less silicone as the elastically-compressible body width 144, defining the size of the top to be coated, is less than that of the convention joint. Additionally, no fixture is required for anchorage. In operation, less strain is imparted to the foam of the main body, while a higher compression is generated, resulting in a tighter seal. Additionally, at the top and bottom of the main body, less strain is introduced in light of the lack of the secondary bodies at those positions. The construction of the present invention further results in the top and bottom being pulled inward against any bowing. This construction results in better recovery as areas of lower compression expand faster than those under higher compression.

Beneficially, the joint seal 100 of the present invention may be horizontally or vertically aligned or in combination and may be used to limit the level of moisture or air penetration to a certain level or area while substantially blocking the moisture or air in a specific region at the surface. The joint seal 100 may also perform symmetrically or asymmetrically based on assembly and material choices. Compared to conventional joint seals, the present joint seal 100 may have a reduced density, a reduced weight when installed, reduced volume of filler or binder, and compression required to function.

The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal comprising:

an elastically-compressive body, the elastically compressive body having a body first side surface, a body second side surface, a body centerline intermediate the body first side surface and the body second side surface, a body first side width from the body first side surface to the body centerline, a body second side width from the body second side surface to the body centerline, a body top surface extending from the body first side surface to the body seconds side surface, a body first end, a body second end, and a body longitudinal axis from the body first end to the body second end;

a first cover plate segment above the elastically-compressible body, the first cover plate segment adjacent the body top surface, the first cover plate segment having a first cover plate segment first side surface positioned between the body first side surface and the body centerline, the first cover plate segment having a first cover plate width greater than the body first side width, the first cover plate segment extending beyond the body first side surface;

a second cover plate segment above the elastically-compressible body, the second cover plate segment adjacent the body top surface, the second cover plate segment having a second cover plate segment first side surface positioned between the body second side surface and the body centerline, the second cover plate segment having a width greater than the body second side width, the second cover plate segment extending beyond the body second side surface;

a ribs penetrating into the elastically-compressive body from above the body top surface;

the first cover plate segment fixed in relation to the rib; and the second cover plate segment fixed in relation to the rib.

2. The expansion joint seal of claim 1, wherein the first cover plate segment and the second cover plate segment are connected to the rib.

3. The expansion joint seal of claim 1, wherein the first cover plate is affixed to a rubber seal at the first cover plate segment first side surface and the second cover plate segment is affixed to the rubber seal at the second cover plate segment first side surface.

4. The expansion joint seal of claim 1, wherein the first cover plate segment is affixed to a third member at the first cover plate segment first side surface and the second cover plate segment is affixed to the third member at the second cover plate segment first side surface.

5. The expansion joint seal of claim 1, wherein the first cover plate segment has a first cover plate segment front surface and the second cover plate segment has a second cover plate segment rear surface, the first cover plate segment and the second cover plate segment are adjacent along the longitudinal axis, and the first cover plate segment front surface and the second cover plate segment rear surface are partially adjacent.

6. An expansion joint seal comprising:

an elastically-compressive body, the elastically compressive body having three body members interspersed with two ribs, a body first side surface, a body second side surface, a body centerline intermediate the body first side surface and the body second side surface, a body first side width from the body first side surface to the body centerline, a body second side width from the body second side surface to the body centerline, a body top surface extending from the body first side surface to the body seconds side surface, a body first end, a body second end, a body longitudinal axis from the body first end to the body second end;

a first cover plate segment above the elastically-compressible body, the first cover plate segment adjacent the body top surface, the first cover plate segment having a first cover plate segment first side surface positioned between the body first side surface and the body centerline, the first cover plate segment having a first cover plate width greater than the body first side width, the first cover plate segment extending beyond the body first side surface;

a second cover plate segment above the elastically-compressible body, the second cover plate segment adjacent the body top surface, the second cover plate segment having a second cover plate segment first side surface positioned between the body second side surface and the body centerline, the second cover plate segment having a second cover plate width greater than the body second side width, the second cover plate segment extending beyond the body second side surface;

the first cover plate segment fixed in relation to a first of the two ribs; and the second cover plate segment fixed in relation to a second of the two ribs.

7. The expansion joint seal of claim 6, wherein the first cover plate segment and the second cover plate segment are affixed to a rubber seal.

8. The expansion joint seal of claim 6, wherein the first cover plate segment and the second cover plate segment are connected to a third member.

9. An expansion joint seal comprising:

an elastically-compressive body, the elastically compressive body having a body first side surface, a body second side surface, a body centerline intermediate the body first side surface and the body second side surface, a body first side width from the body first side surface to the body centerline, a body second side width from the body second side surface to the body centerline, a body top surface extending from the body first side surface to the body seconds side surface, a body first end, a body second end, and a body longitudinal axis from the body first end to the body second end;

a first cover plate segment above the elastically-compressible body, the first cover plate segment adjacent the body top surface, the first cover plate segment having a first cover plate segment first side surface positioned between the body first side surface and the body centerline, the first cover plate segment having a first cover plate width greater than the body first side width, the first cover plate segment extending beyond the body first side surface;

a second cover plate segment above the elastically-compressible body, the second cover plate segment adjacent the body top surface, the second cover plate segment having a second cover plate segment first side surface positioned between the body second side surface and the body centerline, the second cover plate segment having a second cover plate segment width greater than the body second side width, the second cover plate segment extending beyond the body second side surface;

a plurality of ribs penetrating into the elastically-compressive body from above the body top surface;

the first cover plate segment fixed in relation to one of the plurality of ribs; and the second cover plate segment fixed in relation to another of the plurality of ribs.

* * * * *